United States Patent [19]

Kishiyama

[11] 4,328,785

[45] May 11, 1982

[54] FIREPLACE HEAT SINK

[76] Inventor: Lawrence K. Kishiyama, 11716 Four Mile Rd., Cheyenne, Wyo. 82001

[21] Appl. No.: 189,734

[22] Filed: Sep. 22, 1980

[51] Int. Cl.[3] ..... F23H 13/06

[52] U.S. Cl. ..... 126/165; 126/152 B

[58] Field of Search ..... 126/164, 165, 152 A, 126/152 B, 120, 298, 141, 92 A, 400

[56] References Cited

U.S. PATENT DOCUMENTS

| | | | |
|---|---|---|---|
| 2,585,523 | 2/1952 | Wellman | 126/298 |
| 2,985,165 | 5/1961 | Peterson et al. | 126/165 |
| 3,213,846 | 10/1965 | Rogers, Jr. et al. | 126/4 |
| 3,439,667 | 4/1969 | Stone | 126/165 |
| 3,582,250 | 6/1971 | Chatfield | 126/164 |
| 4,094,302 | 6/1978 | Rohr | 126/400 |
| 4,121,563 | 10/1978 | Gold | 126/400 |

*Primary Examiner*—James C. Yeung
*Attorney, Agent, or Firm*—Klaas & Law

[57] ABSTRACT

A fireplace grate having an upstanding frame supporting a basket a distance above the grate, without blocking the fireplace chimney, with the basket forming perforate reservoir filled with lumps of porous lava rock.

1 Claim, 4 Drawing Figures

FIREPLACE HEAT SINK

This application relates to fireplace apparatus for holding a heat sink in the flames of the fire, for releasing heat after the fire has died out.

PRIOR ART

Fireplaces are a part of many homes, using as a fuel any available wood, peat, coal, or the like. A fireplace is quite inefficient, in most cases, as the major quantity of heat goes up the chimney. Once the fire dies down, the residual heat of the fireplace material, also, rapidly disipates up the chimney. Various means have been proposed, in the art, to store some of the heat produced by the fire for later release. These include a furnace arrangement by Gold, U.S. Pat. No. 4,121,563, where stones are placed on rod mesh trays in space above the combustion chamber giving off heat to the air in the plenum and to the heat ducts.

Heat storage bricks are built into a furnace in Rohr, U.S. Pat. No. 4,094,302, where the flame from a forced burner impinges on the brick lattice work.

A gas fired fireplace basket is provided with lump of rock in Chatfield U.S. Pat. No. 3,582,250 whereby the flame is directed toward the lumps heating them.

A brick work furnace is described in Navarro U.S. Pat. No. 3,548,764 having a perforate brick stack to be heated during furnace on times and give up heat during off times.

THE PRESENT INVENTION

The present invention is a log burning grate, with a frame holding a rock reservoir above the burning logs on the grate and adjacent to the outlet communicating with the chimney. The rocks absorb the heat from the flame and products of combustion going up the chimney, and releases the heat when the fire is out. The device provides a heat sink for a fireplace without modification of the existing fireplace.

OBJECTS OF THE INVENTION

Among the objects and advantages of the invention is to provide an addition to an existing fireplace without modification of the fireplace and providing a heat sink.

Another object of the invention is to provide a fireplace grate and an attached upper reservoir for porous rock as a heat sink for normally waste heat going up the chimney, and releasing the heat over a long period of time after the fire has gone out.

These and other objects and advantages of the invention may be ascertained by references to the following description and appended illustrations.

GENERAL DESCRIPTION OF THE ILLUSTRATIONS

DETAILED DESCRIPTION OF THE ILLUSTRATIONS

Figure 1:
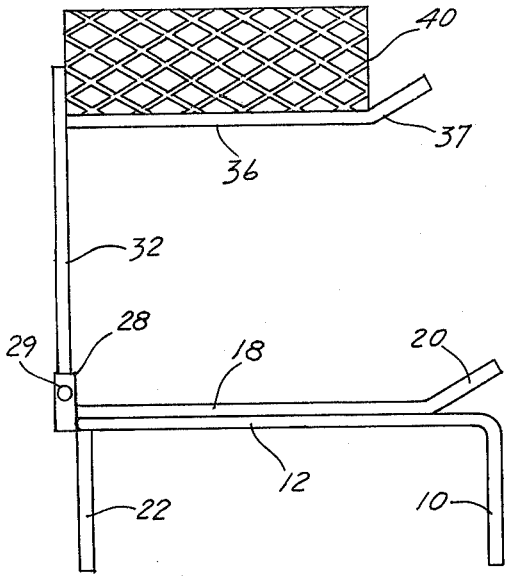
FIG. 1 is a side elevational view of a grate and heat sink reservoir according to the invention.

In the preferred form of the invention shown in the drawings, a grate, for burning logs, includes front legs 10 down-turned from end grate bars 12. The bars 12 are welded to the ends of back support grate bar 14 and the ends of front support grate bar 16. A series of spaced apart log holding bars 18, with upturned ends 20, are spacedly welded to the back bar 14 and to the front bar 16 at right angles, forming a wood burning grate. Rear legs 22 are welded to the back frame bar 14 and to the end of the second from each end of the log holding bars 18. The legs 22 are matched in length with the front legs 10 to provide a generally horizontal grate in a fireplace floor. The legs 22 may, also, be down-turned portions of the log holding bars, in the manner of the front legs.

A pair of upright tubes 26 and 28 are welded on to the rear bar 14 and to the adjacent log holding bars, generally adjacent the rear legs 22. An upright, cylindrical bar member 30 is telescoped in tube 26 and is releasably secured by a set screw 27. Similarly an upright bar 32 is telescoped in tube 28 and is secured by a set screw 29. Near the top of bar member 30 is welded a horizontal basket holding bar 34, with an upturned end 35, leaving an upstanding end 31 on the bar. Similarly, a horizontal bar 36, with an upright end 37, is secured near the top of bar 32 leaving an end 33 on the bar 30. A rectangular, low sided, open top basket 40 is mounted on the horizontal bars 34 and 36. The basket is formed of punched and expanded metal sheet forming a perforate basket with an open top. The basket may be welded or otherwise secured on the bars, or left free. The bars of the grate are formed of hot rolled steel and are preferably about $\frac{5}{8}$ inch round bar stock. The basket is preferably made of heavy guage steel sheet, 16 guage or larger, and may be perforated in any desired way, leaving a large passage area for flame and gas from the fire.

Figure 4:
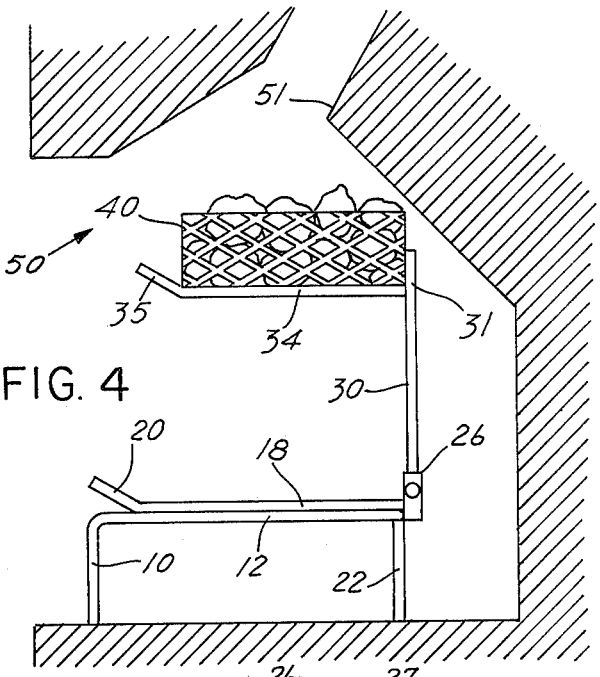
FIG. 4 is side elevational view of the grate and heat sink reservoir of the invention mounted in a fireplace (sectioned) showing the positioning of the heat sink in the space of the fireplace.
Figure 2:
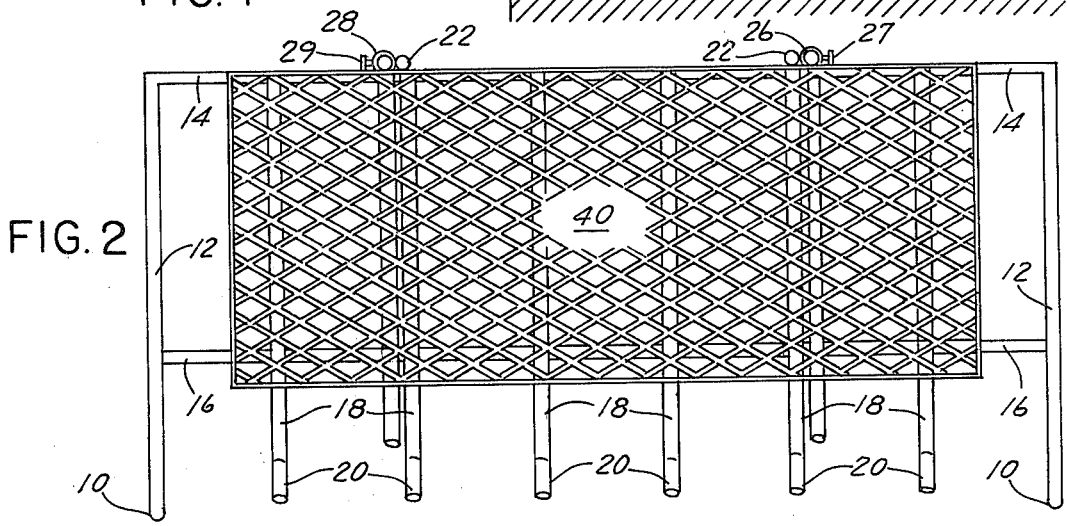
FIG. 2 is a top plan view of the device of FIG. 1.
Figure 3:
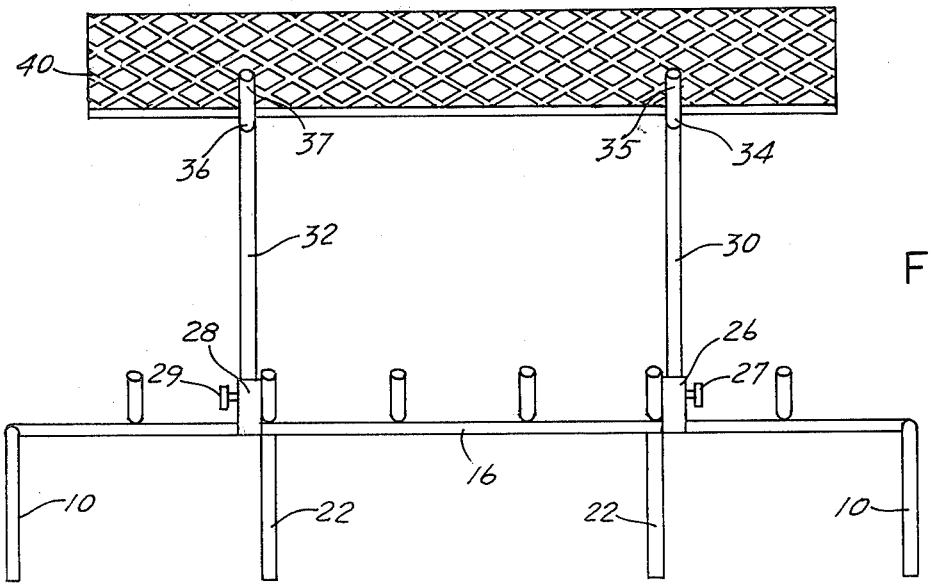
FIG. 3 is front elevation thereof.

For use, the log holding grate portion is placed in a fireplace 50 (generally shown in FIG. 4). The bars 30 and 32 are cut to desired height, to position the basket 40 adjacent but below chimney opening 51. With bars telescoped in the holding tubes, the set screws are tightened to secure them in place. The basket is positioned on the holding bars, if free, and is filled with highly porous lava rock, or similar heat holding rock solids. The rock is in relatively large lump, some 3" to 6" nominal dimension. A basket of about 20 inches by 8 inches with sides of 4 inches is satisfactory for most fireplaces of log burning size. A 24 inch long by 14 inch grate is satisfactory to hold the weighted basket. Of course, different sizes of grates and baskets may be made to fit the particular fireplace.

The uprights 30 and 32 should be some 18 inches or longer to permit a multiple log fire, on the grate. The rock absorbs heat during the burning of the logs. When the fire is out, the chimney vent is closed, and the rocks continue to give up heat to the room for some 4 to 6 or more hours. During the burning of the fire, the rocks absorb heat and, also, radiates heat to the room, so that less wood is consumed. The problem of sparks from an unattended fire are eliminated when the fire goes out, but the rocks continue to release heat for a long time thereafter. Using a volcanic rock, one fireplace effectively provides heat release for from 6 to 10 hours, after burning logs on the grate for $2\frac{1}{2}$ hours. Also, with the fire out, the unit emits heat without odor or pollutants.

The units are made for retrofitting existing fireplaces and may be sold as a kit. The bars 30 and 31 are releasably held in the upright tubes, and are secured by the set-screws. The basket, if free, is positioned on the horizontal bars, and then filled with the rock.

What is claimed is:

1. A log burning grate and heat sink device comprising:

(A) a unitary lowermost grate means for holding a plurality of logs thereon in a fireplace and having:

(1) a rigid generally rectangular frame defined by a pair of elongated spaced parallel horizontally extending rigid front and rear support members and a pair of elongated spaced parallel horizontally extending rigid side support members with front end portions extending outwardly beyond the front support member;

(2) a plurality of spaced parallel horizontally extending rigid cross support members extending laterally between said front and rear support members with upwardly inclined front end portions extending outwardly beyond the front support member;

(3) a pair of spaced front leg members extending vertically downwardly from said front end portions of said side support members;

(4) a pair of spaced rear leg members extending vertically downwardly from said rear support member and being located between and spaced inwardly of said front leg members;

(5) a pair of spaced upwardly extending tubular sleeve members rigidly connected to said rear support member adjacent said rear leg members;

(B) an uppermost perforate basket means rigidly mounted on said lowermost grate means in upwardly spaced relationship thereto for holding a pile of volcanic rocks above the logs on the lowermost grate means adjacent to a fireplace chimney opening whereby the rocks are heated by combustion gases during burning of the logs and thereafter radiate heat outwardly from the fireplace; said basket means having a rectangular peripheral configuration with a width approximately equal to the distance between said front and rear support members and a length less than the distance between said side support members of said grate means;

(C) basket support means for rigidly supporting said basket means above said grate means which includes only a pair of spaced parallel generally L-shaped support members each of which comprises:

(1) a vertically extending support section having a lower end portion mounted in one of said tubular sleeve members adjacent and rigidly supported by the rear support member of said grate means and an upper end portion adjacent the chimney opening; and (2) an horizontally extending support section rigidly connected to said upper end portion and extending forwardly therefrom in cantilever fashion toward the front of the fireplace.

* * * * *